US012331665B2

(12) United States Patent
Andrisani

(10) Patent No.: US 12,331,665 B2
(45) Date of Patent: Jun. 17, 2025

(54) ROCKER ARM ASSEMBLIES

(71) Applicant: Eaton Intelligent Power Limited, Dublin (IE)

(72) Inventor: Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/799,421

(22) PCT Filed: Feb. 19, 2021

(86) PCT No.: PCT/EP2021/025068
§ 371 (c)(1),
(2) Date: Aug. 12, 2022

(87) PCT Pub. No.: WO2021/164947
PCT Pub. Date: Aug. 26, 2021

(65) Prior Publication Data

US 2023/0107801 A1 Apr. 6, 2023

Related U.S. Application Data

(60) Provisional application No. 62/978,815, filed on Feb. 19, 2020.

(51) Int. Cl.
*F01L 1/18* (2006.01)
*F01L 1/20* (2006.01)
(Continued)

(52) U.S. Cl.
CPC ..... *F01L 1/181* (2013.01); *F01L 1/182* (2013.01); *F01L 1/20* (2013.01); *F01L 1/22* (2013.01);
(Continued)

(58) Field of Classification Search
CPC . F01L 1/181; F01L 2001/467; F01L 2305/00; F01L 13/06; F01L 2001/186;
(Continued)

(56) References Cited

U.S. PATENT DOCUMENTS 4,200,081 A 4/1980 Meyer et al.
4,227,494 A 10/1980 Uitvlugt
(Continued)

FOREIGN PATENT DOCUMENTS

CN 109328258 A 2/2019
CN 109923286 A 6/2019
(Continued)

OTHER PUBLICATIONS

International Search Report and Written Opinion for PCT/EP2021/025068, mailed Jun. 9, 2021; pp. 1-15.
(Continued)

*Primary Examiner* — Wesley G Harris
(74) *Attorney, Agent, or Firm* — Baker Botts L.L.P.

(57) ABSTRACT

A rocker arm assembly can comprise a rocker tube configured to be positioned around a rocker shaft, the rocker tube comprising a retention mechanism. A first rocker arm can be press-fit to the rocker tube. A second rocker arm can be pivotably mounted around the rocker tube and retained on the rocker tube by the retention mechanism. An alternative rocker arm assembly, that can be combined with the first rocker arm assembly, can comprise a first and second rocker am and a plate fixed to the first rocker arm. The plate can comprise an extension extending over the second rocker arm. A lost motion spring can be installed between the second rocker arm and the extension.

20 Claims, 7 Drawing Sheets

(51) Int. Cl.

| | |
|---|---|
| ***F01L 1/22*** | (2006.01) |
| ***F01L 1/26*** | (2006.01) |
| ***F01L 1/46*** | (2006.01) |
| ***F01L 13/00*** | (2006.01) |
| ***F01L 13/06*** | (2006.01) |

(52) U.S. Cl.
CPC ..... *F01L 1/26* (2013.01); *F01L 1/46* (2013.01); *F01L 13/0005* (2013.01); *F01L 13/06* (2013.01); *F01L 2001/186* (2013.01); *F01L 2001/187* (2013.01); *F01L 2001/467* (2013.01); *F01L 2013/001* (2013.01); *F01L 2305/00* (2020.05)

(58) Field of Classification Search
CPC ..... F01L 2013/001; F01L 1/18; F01L 1/46; F01L 13/0005; F01L 1/182; F01L 1/20; F01L 1/22; F01L 1/26; F01L 2001/187; F01L 1/053
See application file for complete search history.

(56) References Cited

U.S. PATENT DOCUMENTS

| | | | | |
|---|---|---|---|---|
| 6,041,747 | A | 3/2000 | Kotani et al. | |
| 6,273,039 | B1 | 8/2001 | Church | |
| 6,283,077 | B1 | 9/2001 | Kotani et al. | |
| 6,354,265 | B1 | 3/2002 | Hampton et al. | |
| 6,491,008 | B1 | 12/2002 | Zubeck | |
| 7,201,126 | B1 * | 4/2007 | Seitz | F01L 1/185 123/90.39 |
| 2006/0107915 | A1 | 5/2006 | Fujita | |
| 2007/0193543 | A1 * | 8/2007 | Best | F01L 13/0005 123/90.39 |
| 2008/0271693 | A1 * | 11/2008 | Edelmayer | F01L 13/0005 123/90.44 |
| 2009/0107430 | A1 * | 4/2009 | Daigo | F02D 41/0245 123/90.15 |
| 2010/0108007 | A1 * | 5/2010 | Meistrick | F01L 13/065 123/90.46 |
| 2013/0239919 | A1 * | 9/2013 | Manther | F01L 13/0036 123/90.39 |
| 2014/0130774 | A1 * | 5/2014 | Le Forestier | F01L 13/0021 123/321 |
| 2014/0238015 | A1 * | 8/2014 | Roberts | F01L 1/267 60/594 |
| 2014/0251266 | A1 * | 9/2014 | Emmons | F02D 13/04 123/321 |
| 2016/0281612 | A1 * | 9/2016 | Toth | F01L 1/18 |
| 2017/0009610 | A1 | 1/2017 | Ahmed | |
| 2017/0145876 | A1 | 5/2017 | Pham | |
| 2017/0350284 | A1 | 12/2017 | Kamichika | |
| 2018/0187579 | A1 | 7/2018 | Cecur | |
| 2019/0063268 | A1 | 2/2019 | Buonocore et al. | |
| 2019/0107011 | A1 * | 4/2019 | Contarin | F01L 13/065 |
| 2020/0224561 | A1 * | 7/2020 | Baltrucki | F01L 9/12 |
| 2020/0325803 | A1 | 10/2020 | Patil et al. | |
| 2020/0408113 | A1 * | 12/2020 | Radulescu | F01L 1/047 |
| 2023/0015394 | A1 * | 1/2023 | Mandell | F01L 9/40 |

FOREIGN PATENT DOCUMENTS

| | | | | |
|---|---|---|---|---|
| CN | 109952415 | A | 6/2019 | |
| CN | 110582620 | A | 12/2019 | |
| CN | 110685768 | A | 1/2020 | |
| DE | 9316745 | U1 | 3/1995 | |
| DE | 102008027649 | A1 | 12/2009 | |
| EP | 3296531 | A1 | 3/2018 | |
| JP | 2007146783 | A | 6/2007 | |
| JP | 2010275935 | A | 12/2010 | |
| WO | WO-2006090292 | A2 * | 8/2006 | F01L 1/18 |
| WO | WO-2012038190 | A1 * | 3/2012 | F01L 1/181 |
| WO | 2012085394 | A1 | 6/2012 | |
| WO | 2019036272 | A1 | 2/2019 | |
| WO | 2019133658 | A1 | 7/2019 | |
| WO | WO-2021047796 | A1 * | 3/2021 | F01L 1/181 |
| WO | WO-2021144148 | A1 * | 7/2021 | F01L 1/182 |
| WO | WO-2021239273 | A1 * | 12/2021 | F01L 1/181 |
| WO | WO-2022069080 | A1 * | 4/2022 | F01L 1/153 |
| WO | WO-2022100886 | A1 * | 5/2022 | F01L 1/18 |
| WO | WO-2022111854 | A2 * | 6/2022 | F01L 1/18 |
| WO | WO-2022111856 | A1 * | 6/2022 | F01L 1/18 |
| WO | WO-2022189042 | A1 * | 9/2022 | F01L 1/18 |

OTHER PUBLICATIONS

CN OA for Chinese Application No. 202180015170.5 mailed on Mar. 31, 2023, 10 pages.
Chinese Search Report received for CN Application No. CN2021800151419, 2 pages, Aug. 21, 2023.
CN OA for Chinese Application No. 202180015141.9, 16 pages, Mar. 31, 2023.

* cited by examiner

ROCKER ARM ASSEMBLIES

This application is a U.S. National Stage application under 35 U.S.C. § 371 of International Application No. PCT/EP2021/025068, filed on 19 Feb. 2021, which claims the benefit under 35 U.S.C. § 119 (e) of U.S. Provisional Patent Application No. 62/978,815, filed 19 Feb. 2020.

FIELD

This application provides subassemblies of valvetrain components that can be configured as rocker arm assemblies. The rocker arm assemblies comprise one or more retention assembly.

BACKGROUND

OEMs want quick installation of purchased parts. And, OEMs want sophisticated relationships among those parts. This juxtaposition presents challenges to a parts supplier, who must also provide the desired actuation in a small space and with a light weight.

SUMMARY

The methods and devices disclosed herein overcome the above disadvantages and improves the art by way of alternative rocker arm assemblies that can be combined.

A first rocker arm assembly can comprise a rocker tube configured to be positioned around a rocker shaft. The rocker tube can comprise a retention mechanism. A first rocker arm can be press-fit to the rocker tube. A second rocker arm can be pivotably mounted around the rocker tube and retained on the rocker tube by the retention mechanism.

An alternative rocker arm assembly, that can be combined with the first rocker arm assembly, can comprise a first rocker arm, a second rocker am, and a plate fixed to the first rocker arm. The plate can comprise an extension extending over the second rocker arm. A lost motion spring can be installed between the second rocker arm and the extension. This alternative rocker arm assembly can be configured to pivotably mount around a rocker shaft with or without the rocker tube of the first rocker arm assembly.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

Figure 1:
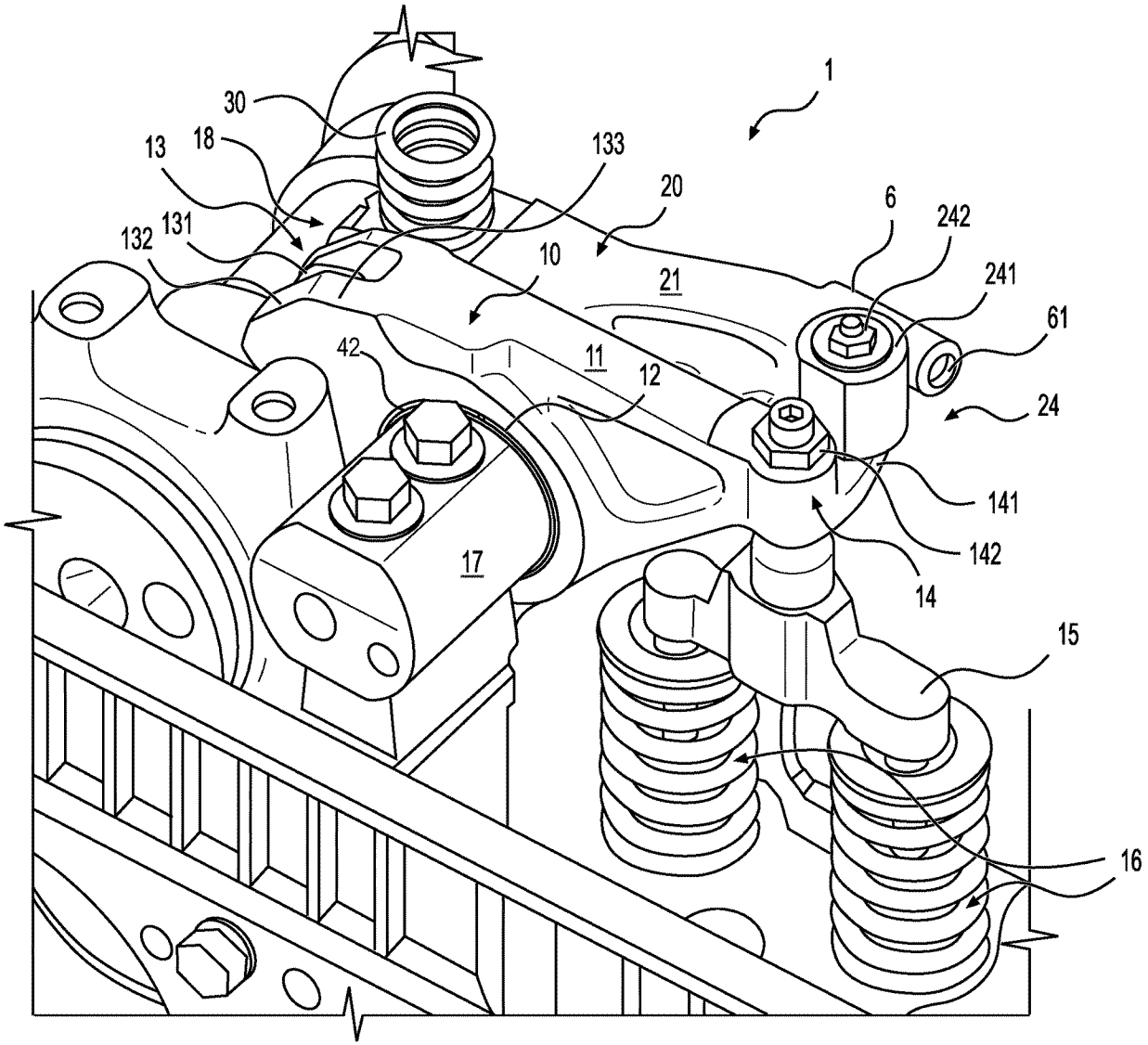
FIG. 1 is a view of portions of a valvetrain assembly comprising a rocker arm assembly.
Figure 2A:
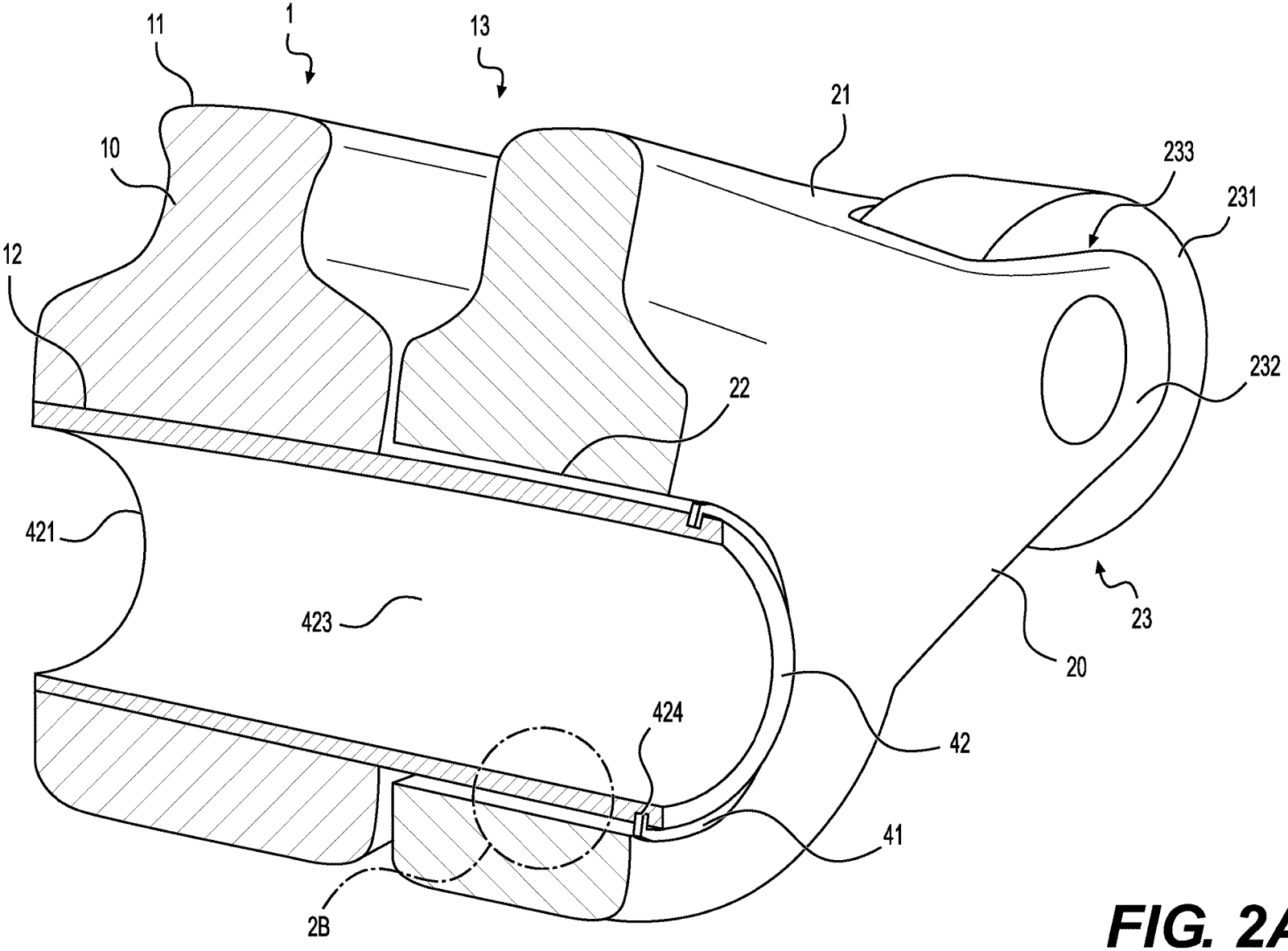
FIGS. 2A & 2B are views of a first retention assembly relative to portions of a rocker arm assembly.
Figure 2B:
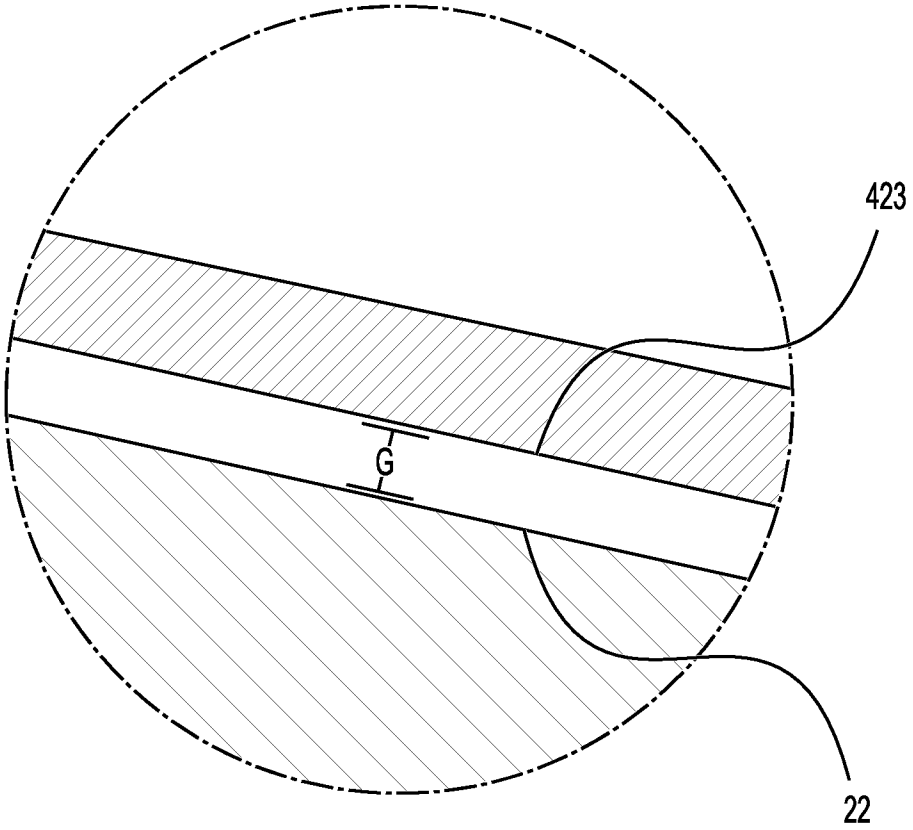
Figure 3A:
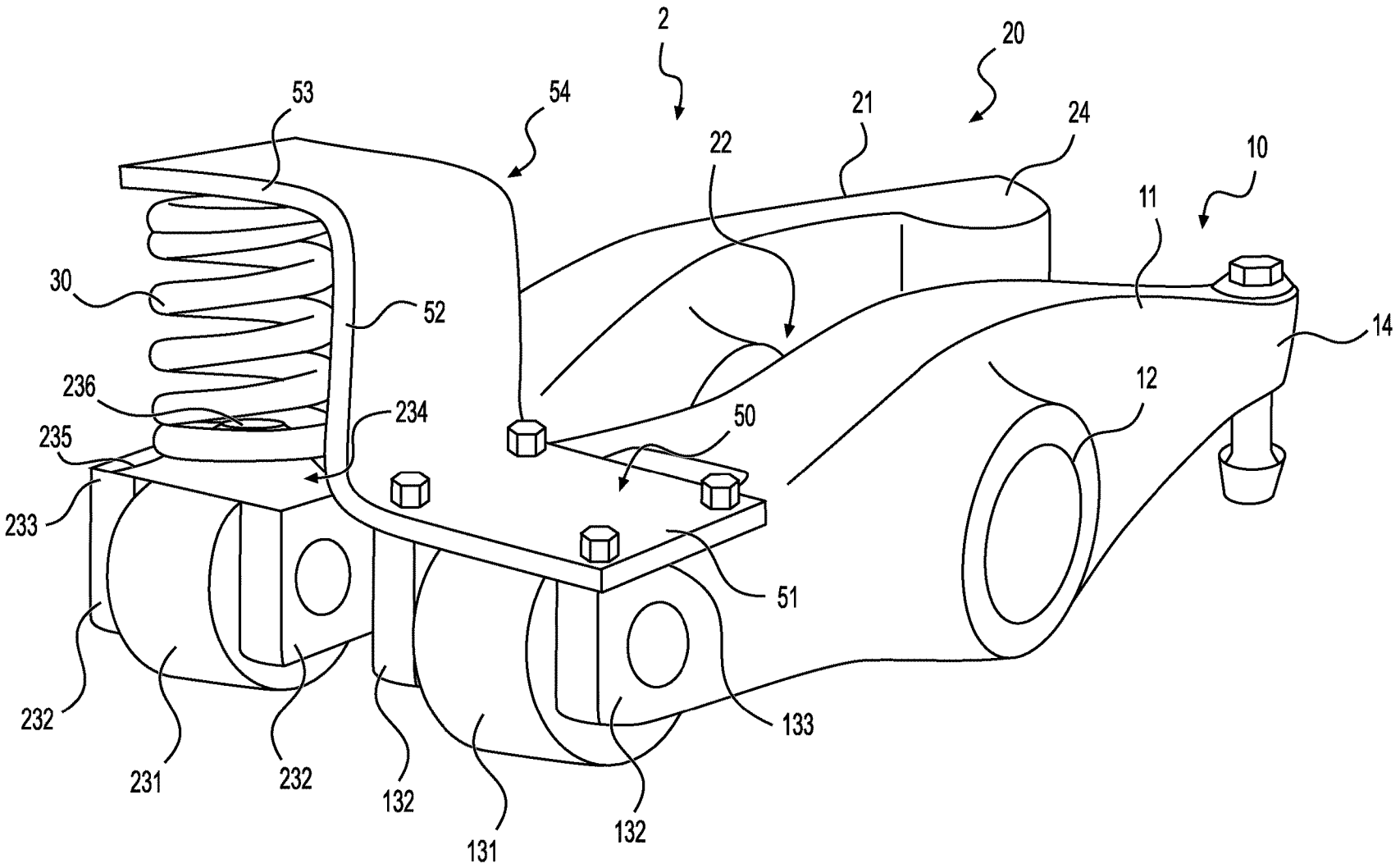
FIGS. 3A & 3B are views of a second retention assembly relative to alternative rocker arm assemblies.
Figure 3B:
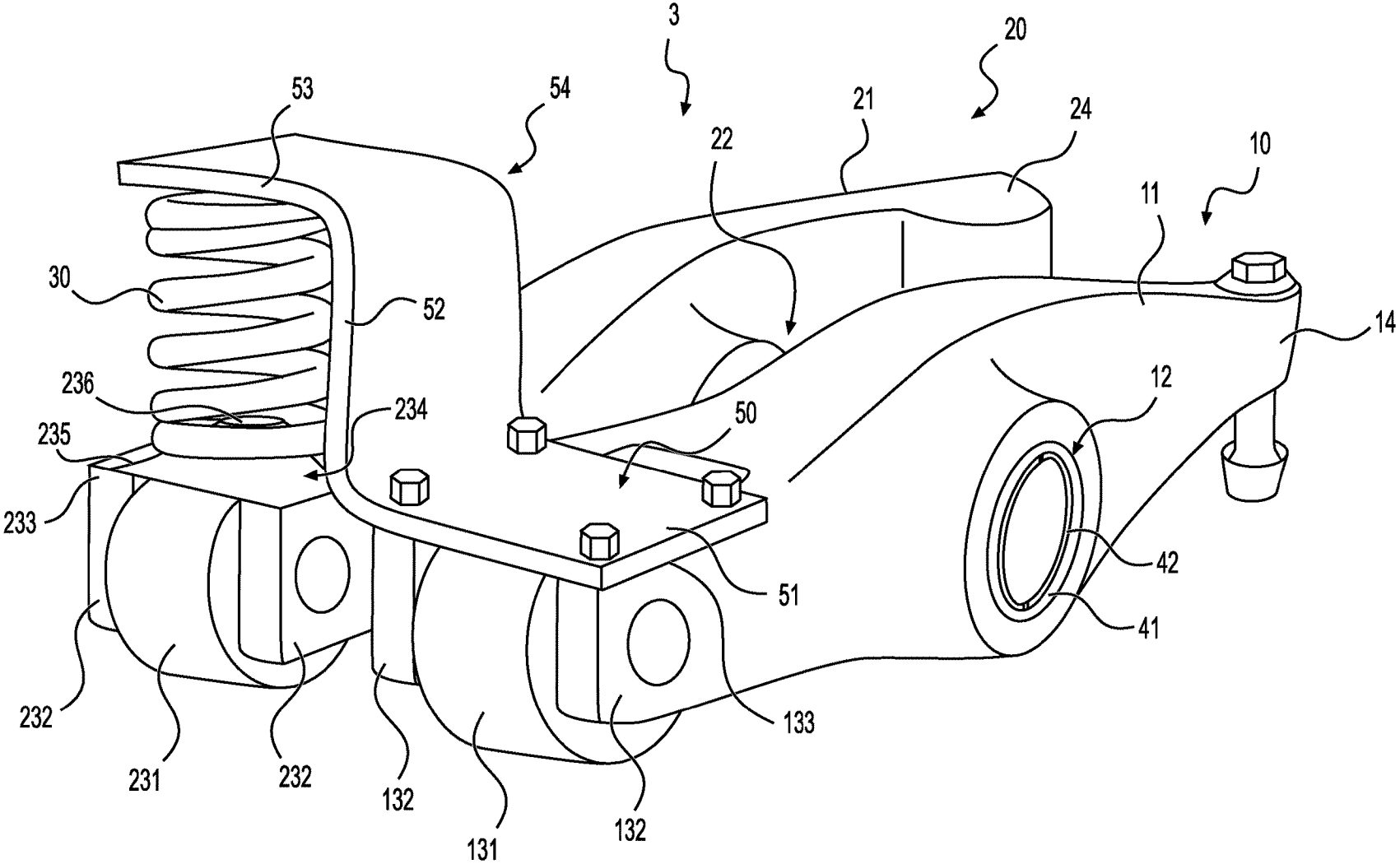
Figure 4:
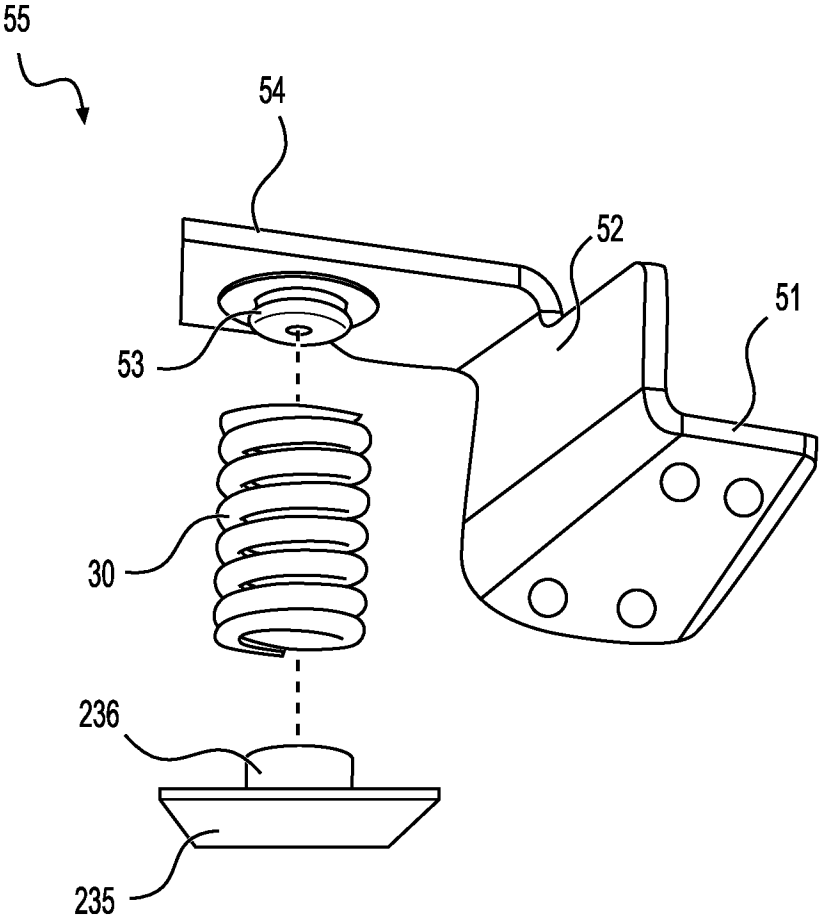
FIG. 4 is an exploded view of the second retention assembly.
Figure 5:
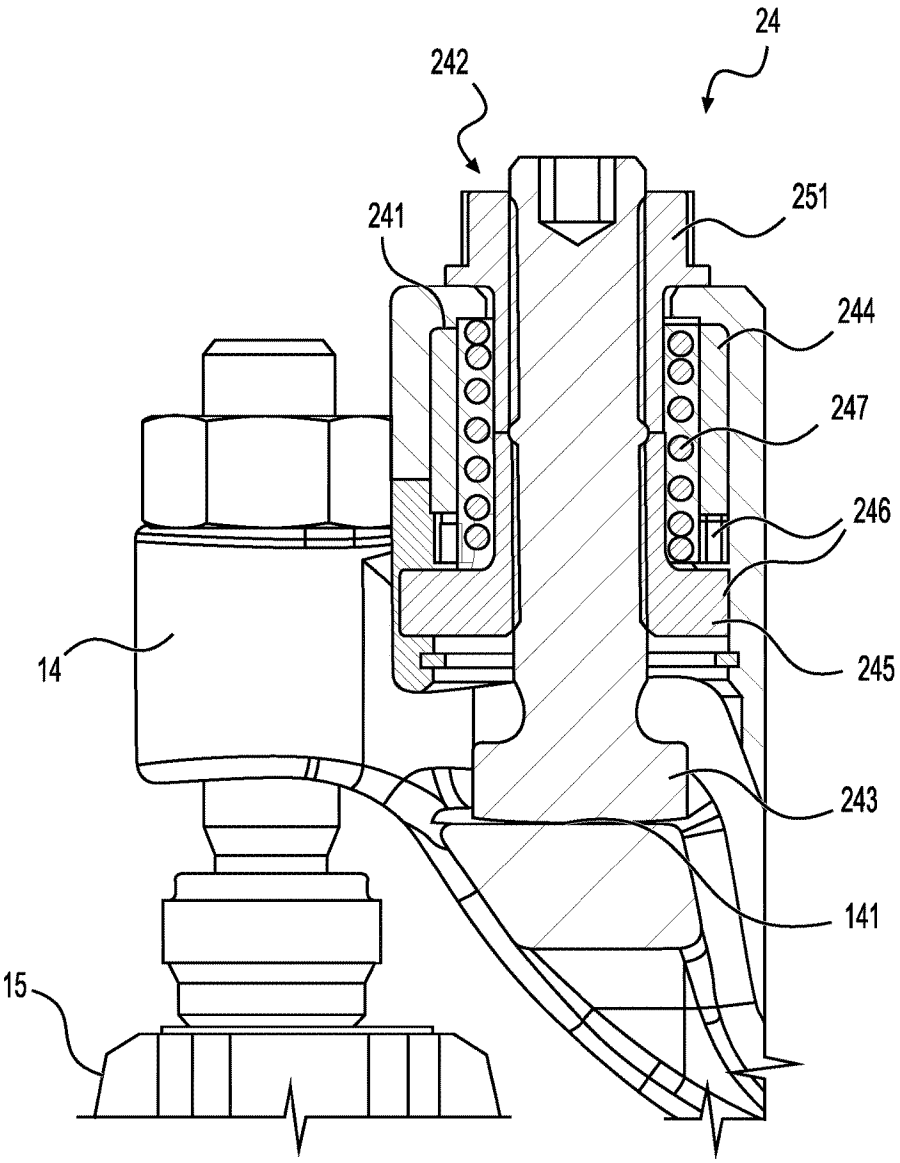
FIG. 5 is an example of a castellation device as a capsule.

A subassembly of valvetrain components will be described. FIG. 1 shows portions of a valvetrain assembly 200. A first rocker arm 10 is assembled next to a second rocker arm 20 for rotation around a rocker shaft 17. An overhead cam rail 18 is positioned to rotate cams to convey valve lift profiles to the first and second rocker arms 10, 20 to lift and lower valves 16. Two valves 16 are shown coupled to a bridge 15.

In the example, the first rocker arm 10 comprises body 11 with a rotation bore 12 configured for pivoting or rotating around rocker shaft 17. A lifter end 13 can comprise either a tappet or a roller 131 hung between roller arms 132 for interaction with the overhead cam rail 18. The valve end 14 can comprise a target surface, such as a cantilever 141, machined or molded flat, groove, or projection. A lash adjustment, such as a mechanical or hydraulic lash adjuster can be configured in the valve end 14. Alternatively, a switchable capsule 142 can be substituted or combined with lash adjustment to provide variable valve lift to the associated valves 16. A castellation device, latched device, plunger, ball and pintle, among others, can comprise a portion of a switchable capsule 142 with actuation comprising one or more hydraulic feed through the body 11, or an external actuator connected to the valve end 14, such as a hydraulic or pneumatic supply line or linkage and solenoid among many other alternatives.

Second rocker arm 20, in the example, is configured to push on the cantilever 141. But, other configurations and target surfaces can be had, including an arrangement where the second rocker arm 20 presses on a portion of the valve bridge 15, the valve bridge comprising an engine braking modification, among numerous alternatives. Second rocker arm 20 can comprise a capsule 242 in a capsule bore 241 in the valve end 24. Similar to first rocker arm 10, the second rocker arm 20 can comprise, among many the many above-listed alternatives, a lash adjusting capsule, a switchable capsule such as a castellation device or movable piston, and combinations thereof. A second bore 6 is shown and can comprise a compliance capsule 61 or other actuator that can be connected to a hydraulic supply in the rocker arm body 21 or to an external actuator and linkage, among many alternatives. For example, if a castellation device were used as the capsule 242, a rotatable first castellation piece 244 of the castellation device could be linked to the compliance capsule 61 in the bore. Shifting the compliance capsule 61 in one direction would rotate the first castellation piece 244 of castellation device to a first position. A biasing spring 247 could push from the capsule bore 241 against a second castellation piece 245. The on-position could engage teeth 246 of the first and second castellation pieces 244, 245, thereby allowing lash assembly 251 to transfer a lift profile to the target surface. An off-position could align the teeth 246 to collapse into corresponding cavities between the teeth 246 thereby allowing lash assembly 251, comprised of a lash nut and a pin connected to press-foot 243, to collapse upward in the capsule bore 241. The biasing spring 247 can provide a force to keep the second rocker arm 20 pressed to the target surface of the first rocker arm 10. Another spring mounted in the bore 6 could rotate or bias the first castellation piece 244 to or in a second position. Regardless of the switchable capsule and actuator combination used, it is beneficial to link the first rocker arm 10 to the second rocker arm 20 for their controlled operation.

Alternative retention assemblies 40, 55 can be used alone or in combination to ensure the controlled operation of the first and second rocker arms 10, 20. A supplier of engines or engine-powered devices desires quick and efficient assembly of subcomponents. So, retention assemblies 40, 55 allow the careful placement of the first rocker arm 10 relative to the second rocker arm 20 so that the resulting rocker arm assembly 1, 2, 3 is placed on the engine or engine-powered device quickly and accurately. It can be possible to set the lash in one of the capsules 142, 242 before the rocker arm assembly 1, 2, 3 is placed on the engine, as by using the retention assembly 40, 55 and alignment tools. Setting lash wouldn't interfere with the addition of other engine parts, as the rocker arm assembly 1, 2, 3 could be dropped in place on the rocker shaft 17, and a next step can be pursued. Setting lash is just one example. Calibrating the actuator, such as the compliance capsule 61 relative to capsule 242 could be accomplished prior to rocker arm assembly installation. Or, castellation device pre-alignment or pre-set of reaction spring 30 bias force could be accomplished prior to rocker arm assembly installation. Manufacturing efficiencies can be accomplished at the valvetrain supplier because the single sub assembly is easier to handle on the assembling line for the engine. Scrap can be reduced by sub-compartmentalizing the sections of the rocker shaft 17 into drop-on sections of rocker arm assemblies 1, 2, 3.

A first rocker arm assembly 1 can be formed as shown with a retention assembly 40. A first rocker arm 10 for a first valve lift and a second rocker arm 20 for a second valve lift can be configured with a rocker tube 42 for rotating around the rocker shaft 17. The rocker tube 42 can be press fit inside the rocker shaft hole of the first rocker arm 10. The second rocker arm 20 can rotate around the rocker tube 42. A retention assembly 40 such as a clip, rim, circlip, Seeger ring, or the like, can prevent the second rocker arm 20 from falling off the rocker tube 42.

The rocker tube 42 can be a hollow cylinder sized to fit around the rocker shaft 17. The rocker tube 42 can freely rotate around the rocker shaft 17. With the first rocker arm 10 secured to move in unison with the rocker tube 42, the first rocker arm 10 can move with the rotation of the rocker tube 42 when a lift profile is applied to lifter end 13 by overhead cam 18. Rocker tube 42 can be slip fit around the rocker shaft 17. The overhead cam 18 can be configured to rotate the first rocker arm 10 together with the rocker tube 42 around the rocker shaft 17. A large contact area of the rocker tube 42 distributes a load of the second rocker arm 20 thereby increasing durability.

Second rocker arm 20 is not press fit to the rocker tube 42. Second rocker arm 20 can be slip fit at slip fit area 423 and a gap G can be built into rocker arm assembly 1 so that the outer diameter of the rocker tube 42 is smaller than an inner diameter of rotation bore 22. Second rocker arm 20 can rotate around a bigger shaft formed by the rocker tube 42, thus reducing contact stress.

The rocker tube 42 comprises a press fit area 421 that can be press fit to the first rocker arm 10 and comprises a slip fit area 423 that can be slip fit to the second rocker arm 20. Lateral motion of the second rocker arm 20 is restricted by the press fit first rocker arm 10 on a first side and by a retention mechanism 41 on a second side. The second rocker arm 20 will not fall off the rocker tube 42 as there is the first rocker arm 10 on one side and the retention mechanism 41 on the other side. Retention mechanism 41 can comprise a fastener or retaining ring. It can comprise a ring or bracket with or without open ends that can pressed or snapped in place. Retention mechanism 41 can be toothed, a so called Seeger ring, so that it can be pressed in place to clench its position on the rocker tube 42. Or, a guide 424, such as a groove, notch, or crimp, can be formed on the rocker tube 42 with the retention mechanism 41 seated in the guide 424. A bushing or ring can be pressed to the rocker tube 42. It can be possible to include a molded or integrally formed rim as the retention mechanism 41 in lieu of the mounted fastener or retaining ring.

Assembly can be accomplished by either dropping the second rocker arm 20 against the retention mechanism 41 and then pressing the first rocker arm 10 against the second rocker arm 20. Or, the first rocker arm 10 can be pressed to the press fit area 421 of the rocker tube 42 with the second rocker arm 20 laterally locked in place by mounting the retention mechanism 41. The relationship of the one rocker arm pressing on the other rocker arm can be set prior to locking the lateral motion of the rocker arms. For example, the second rocker arm 20 pushing on the cantilever 141 or other target surface can be facilitated before laterally locking motion. Or, the reaction spring 30 can be set before or after lateral relationship between the first and second rocker arms 10, 20 is locked. The retention assembly 40 can allow the assembler to quickly disassemble the rocker arm assembly 1, 3 if a part breaks, is defective, or misaligns before the rocker arm assembly 1, 3 is completed. Waste and scrap is reduced.

A first rocker arm assembly 1, 3 can comprise a retention assembly 40. The retention assembly 40 can comprise or consist of a rocker tube 42 configured to be positioned around a rocker shaft 17 and a retention mechanism 41 integrally formed or mounted to the rocker tube 42. The rocker arm assembly 1, 3 can comprise a first rocker arm 10 press-fit to the rocker tube 42. A second rocker arm 20 can be pivotably mounted around the rocker tube 42 and retained on the rocker tube 42 by the retention mechanism 41.

An alternative rocker arm assembly 2, 3, can comprise a second retention assembly 55 that can be combined with the first retention assembly 40. Rocker arm assembly 2, 3 can comprise a first rocker arm 10, a second rocker am 20, and a plate 50 fixed to the first rocker arm 10. The plate 50 can comprise an extension 54 extending over the second rocker arm 20. The extension 54 can terminate over the second rocker arm 20 such that it is not mounted to the cylinder block, tower, or other riser of the cylinder head or engine, or alternatively such a connection can be had by extending the far end of the extension 54. A lost motion spring or other reaction spring 30 can be installed between the second rocker arm 20 and a spring surface 53 of the extension 54. Plate 50, also called a reaction plate, can be bent or otherwise formed to comprise a spring cup 52 or other cup-like shape to house the reaction spring 30. This alternative rocker arm assembly 2, 3 can be configured to pivotably mount around a rocker shaft 17 with or without the rocker tube 42 of the first retention assembly 40 of the first rocker arm assembly 1.

Plate 50 can comprise a mounting bracket 51 anchored to roller arms 132 of the first rocker arm 10. Screws, rivets, or other fasteners or welding techniques can secure the bracket 51 firmly to the first rocker arm 10. Mounting bracket 51 can be integrally formed in plate 50 so that it offers rigidity to the extension 54 of the plate 50. When reaction spring 30 is mounted to the second rocker arm 20, it presses firmly between the extension 54 and the second rocker arm 20 thereby linking the first and second rocker arms 10, 20 for shipping or transfer to an assembly line for dropping onto the rocker shaft 17 as a unit. The time and scrap savings of the above retention assembly 40 are applicable to this retention assembly 55.

The extension 54 can comprise the spring cup 52 extending from the mounting bracket 51 to house the reaction spring 30. And, the extension 54 can terminate over the second rocker arm 20. To further strengthen the rigidity of the relationship between the first and second rocker arms 10, 20, several alternative spring guides can be included. A spring guide 234 can be formed over a lifter end 23 of the second rocker arm 20. Spring guide 234 can be set on, secured to, integrally formed, or molded to the lifter end 23. It can comprise a post 236 extending up from a spring plate 235. Spring plate 235 can be formed with a tappet or spring plate 235 can span the roller arms 232. Alternatively, grooves, ridges, or other retention features can be formed in the roller arms 232 themselves, or grooves or ridges can be formed in the spring plate 235 in lieu of the spring post 236.

At the other end of the rocker arm assembly 2, 3, the first rocker arm can comprise the cantilever 141 or other target surface laterally extending towards the second rocker arm 20 to receive force from the second rocker arm 20. If a spring, such as another lost motion or other biasing spring 247, is included in the capsule 242, it can cause the capsule 242 to push on the cantilever 141. Or, the weight of the second rocker arm 20 can push on the cantilever 141. But, the pushing of the valve end 24 of the second rocker arm 20 on the cantilever 141 or other target surface can add additional rigidity to the rocker arm assembly 2, 3 for its ease of drop-on assembly to the rocker shaft 17.

Capsule 242 can comprise a switchable capsule disposed in the second rocker arm 20 of the rocker arm assembly 1, 2, 3. The switchable capsule can be configured to selectively switch between an on-position and an off-position. The on-position results in a transfer of force from the second rocker arm 20 to the cantilever 141 or other target surface. The off-position results in the switchable capsule collapsing against the cantilever. Numerous examples for capsule 242 and related actuator exist in the art, including but not limited to castellation devices and actuator combinations disclosed in, for example, WO 2019/133658, WO 2019/036272, US2020/0325803, US2018/0187579, U.S. Pat. Nos. 4,227,494, 6,354,265, 6,273,039, & 4,200,081. As noted above, an exemplary actuator for the capsule 242 can comprise a compliance capsule 61 in the second rocker arm 20. The compliance capsule 61 can be configured to selectively switch the switchable capsule 242 between the on-position and the off-position.

A valvetrain assembly 200 can be configured with a first rocker arm 10 for conveying a first valve lift to the valves 16 and a second rocker arm 20 for conveying a second valve lift to the valves 16. The rocker arm assembly 1, 2, 3 can be handled as a sub assembly. In the case of the retention assembly 55, assembly on the engine is facilitated, as the need to install a larger reaction bar on the engine can be eliminated. The plate 50 can serve the function of the reaction bar. The difficulty of keeping numerous reaction springs aligned across numerous rocker arm assemblies while installing a reaction bar to the cylinder head or tower of the engine block can be removed by using the plate 50 in the rocker arm assemblies 2, 3.

Other implementations will be apparent to those skilled in the art from consideration of the specification and practice of the examples disclosed herein.

What is claimed is:

1. A rocker arm assembly comprising:

a rocker tube configured to be positioned around a rocker shaft, the rocker tube comprising a retention mechanism;

a first rocker arm press-fit to the rocker tube;

a second rocker arm pivotably mounted around the rocker tube and retained on the rocker tube by the retention mechanism; and a switchable capsule configured to selectively switch between an on-position and an off-position, wherein the first rocker arm is configured to receive a first valve lift profile from a first cam lobe and the second rocker arm is configured to receive a second valve lift profile from a second cam lobe, wherein the first rocker arm comprises a target surface to receive force from the second rocker arm, wherein the on-position of the switchable capsule results in a transfer of force from the second rocker arm to the target surface, and wherein the off-position results in the switchable capsule collapsing against the target surface.

2. The rocker arm assembly of claim 1, further comprising a compliance capsule associated with the second rocker arm, the compliance capsule configured to selectively switch the switchable capsule between the on-position and the off-position.

3. The rocker arm assembly of claim 1, wherein the retention mechanism comprises a toothed ring, a bushing, or a circlip.

4. The rocker arm assembly of claim 1, further comprising:

a plate fixed to the first rocker arm, the plate comprising an extension extending over the second rocker arm; and a lost motion spring installed between the second rocker arm and the extension.

5. The rocker arm assembly of claim 4, further comprising one or more spring posts disposed between the second rocker arm and a raised portion of the extension, the one or more spring posts configured to support the lost motion spring.

6. The rocker arm assembly of claim 4, wherein the plate comprises a mounting bracket anchored to roller arms of the first rocker arm.

7. The rocker arm assembly of claim 4, wherein the extension terminates over the second rocker arm.

8. The rocker arm assembly of claim 1, wherein the first valve lift profile is different from the second valve lift profile.

9. The rocker arm assembly of claim 1, wherein the second rocker arm is axially offset from the first rocker arm along an axis of the rocker shaft.

10. The rocker arm assembly of claim 1, wherein the first rocker arm is configured to receive the first valve lift profile via a first roller mechanism, and wherein the second rocker arm is configured to receive the second valve lift profile via a second roller mechanism.

11. The rocker arm assembly of claim 10, wherein the first roller mechanism and the second roller mechanism are disposed on the same side of a longitudinal plane passing through a central axis of the rocker tube.

12. A rocker arm assembly comprising:

a first rocker arm configured to pivotably mount around a rocker shaft;

a second rocker arm configured to pivotably mount around the rocker shaft;

a plate fixed to the first rocker arm, the plate comprising an extension extending over the second rocker arm;

a lost motion spring installed between the second rocker arm and the extension; and a switchable capsule configured to selectively switch between an on-position and an off-position, wherein the first rocker arm is configured to receive a first valve lift profile from a first cam lobe and the second rocker arm is configured to receive a second valve lift profile from a second cam lobe, wherein the first rocker arm comprises a target surface to receive force from the second rocker arm, wherein the on-position of the switchable capsule results in a transfer of force from the second rocker arm to the target surface, and wherein the off-position results in the switchable capsule collapsing against the target surface.

13. The rocker arm assembly of claim 12, further comprising a rocker tube configured to be positioned around the rocker shaft, the rocker tube comprising a retention mechanism.

14. The rocker arm assembly of claim 12, further comprising a compliance capsule associated with the second rocker arm, the compliance capsule configured to selectively switch the switchable capsule between the on-position and the off-position.

15. The rocker arm assembly of claim 12, wherein the plate comprises a mounting bracket anchored to roller arms of the first rocker arm.

16. The rocker arm assembly of claim 15, wherein the extension comprises a spring cup extending from the mounting bracket, and wherein the spring cup houses the lost motion spring.

17. The rocker arm assembly of claim 12, wherein the extension terminates over the second rocker arm.

18. The rocker arm assembly of claim 17, further comprising a spring guide formed over a lifter end of the second rocker arm.

19. The rocker arm assembly of claim 12, wherein the target surface comprises a cantilever laterally extending towards the second rocker arm.

20. The rocker arm assembly of claim 12, further comprising one or more spring posts disposed between the second rocker arm and a raised portion of the extension, the one or more spring posts configured to support the lost motion spring.

* * * * *